US005738208A

United States Patent [19]

Roubal

[11] Patent Number: 5,738,208

[45] Date of Patent: Apr. 14, 1998

[54] ACCESSORY DEVICE AND METHOD FOR PROTECTING GOLF CLUBS

[76] Inventor: Paul J. Roubal, 5866 Carmen Ct., E., Orchard Lake, Mich. 48324

[21] Appl. No.: 670,173

[22] Filed: Jun. 27, 1996

[51] Int. Cl.[6] ..... A63B 55/00; A63B 57/00

[52] U.S. Cl. ..... 206/315.4; 206/315.3; 150/159

[58] Field of Search ..... 150/159; 206/315.3–315.7

[56] References Cited

U.S. PATENT DOCUMENTS

| | | | |
|---|---|---|---|
| 1,644,592 | 10/1927 | Howland | 206/315.4 |
| 1,918,447 | 7/1933 | Blatz | 206/315.6 X |
| 2,752,973 | 7/1956 | Stamp | 206/315.6 |
| 4,078,594 | 3/1978 | Oeckl | 206/315.4 |
| 4,512,465 | 4/1985 | Jobe | 206/315.4 |
| 4,522,300 | 6/1985 | Hamblet | 206/315.4 |
| 4,635,793 | 1/1987 | Kim | 206/315.6 |
| 4,788,996 | 12/1988 | Forshee | 135/16 |
| 4,865,192 | 9/1989 | Williams | 206/315.6 X |
| 4,905,827 | 3/1990 | Kim | 206/315.3 |
| 4,915,221 | 4/1990 | Spangler | 206/315.4 X |
| 5,209,280 | 5/1993 | Gevas | 150/159 |
| 5,244,086 | 9/1993 | Welch | 150/159 X |

*Primary Examiner*—Sue A. Weaver
*Attorney, Agent, or Firm*—Young & Basile, P.C.

[57] ABSTRACT

An accessory device protects golf clubs from damage during transit or storage. The device includes a head member having a solid plate configuration and having a semi-rigid construction and an extensible rod assembly adapted to be positioned in the golf bag with the lower end of the rod assembly positioned on the base of the golf bag. The head member may be releasably attached to the upper end of the rod assembly or may be stored in a side pocket of the golf bag. The rod assembly is selectively moveable between an extended travel configuration having a length greater than the length of the longest club of the set of clubs, whereby the head member may be releasably attached to the upper end of the rod assembly so as to protectively overlie the head of the longest club to provide protection for the clubs in travel scenarios, and a retracted play configuration having a length less than the length of the golf bag, whereby the head member may be removed from the rod assembly and stored in the side pocket of the golf bag so that the rod assembly may reside unobtrusively in the bag during golf play.

14 Claims, 4 Drawing Sheets

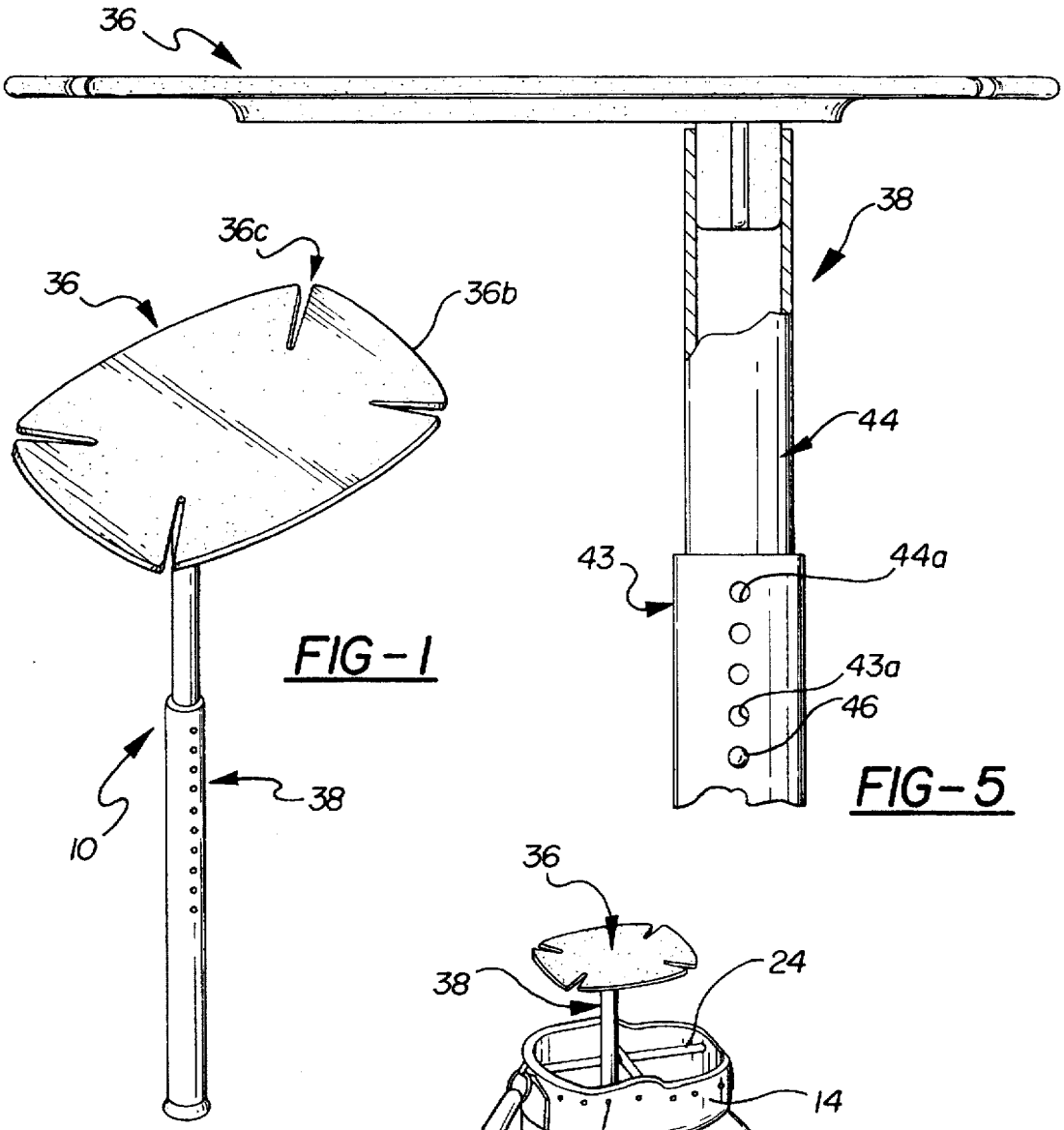
FIG-1
FIG-5
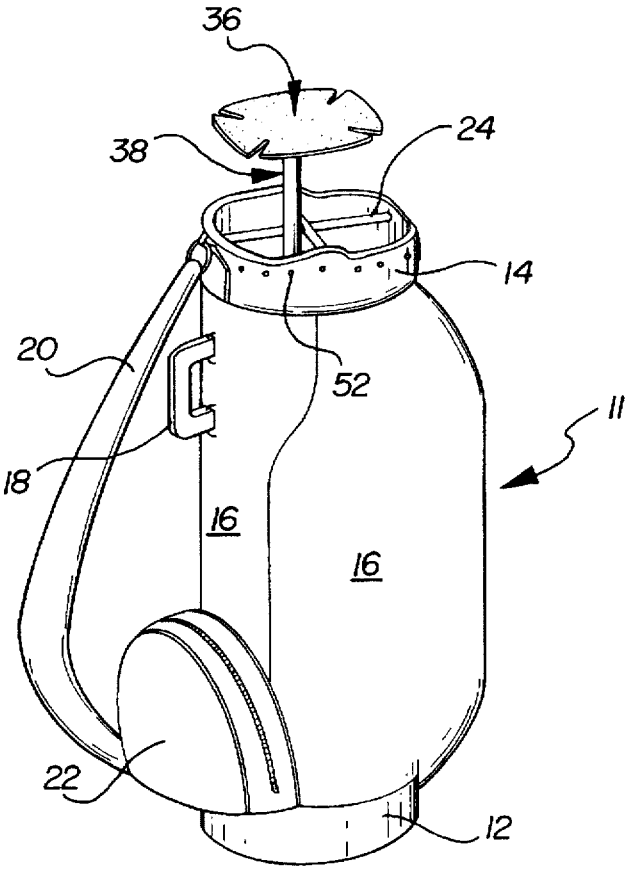
FIG-2

ACCESSORY DEVICE AND METHOD FOR PROTECTING GOLF CLUBS

BACKGROUND OF THE INVENTION

This invention relates to golf equipment and more particularly to a device and method for protecting golf clubs during storage and transport.

Golf clubs when not in use are typically protected by head mittens, especially over the heads of the woods, and by a flexible hood fitted over the heads of the clubs and releasably secured to the upper collar of the golf bag. Whereas these mittens and hoods provide protection from the elements they do not provide any significant protection against shaft breakage due to rough handling during storage and transport. Travel bags of a fabric construction are also available to enclose the golf bag and clubs for shipping/transport. These bags, again, offer little protection against club shaft breakage due to rough handling. Rigid clam shell structures are also available to enclose the bag and clubs and, whereas these rigid structures are generally effective in combatting club shaft breakage due to rough handling, they create a large, heavy and cumbersome total package which complicates storage, handling, and shipment. Accessory devices have also been proposed for insertion in the golf bag to overlie the clubs and protect the clubs against longitudinal compacting forces but these accessory devices are ineffective in protecting the clubs and/or present storage and handling problems when not in use.

SUMMARY OF THE INVENTION

This invention is directed to the provision of an improved device and method for protecting golf clubs.

More particularly, this invention is directed to the provision of a simple and inexpensive device that is effective in protecting golf clubs against breakage during shipping and storage.

The accessory device of the invention is intended for use with a golf set including a set of golf clubs and a golf bag for receiving the clubs with the lower ends of the clubs positioned on a base of the bag and the clubs extending upwardly within the bag to position the club heads at a level above the leading, top edge of the bag.

According to the invention, the device includes a head member defining a solid lower face; an extensible rod assembly having upper and lower ends and adapted to be positioned in the golf bag with the lower end thereof positioned on the base of the golf bag and the rod assembly extending upwardly in the bag to position the upper end thereof at a location proximate the upper end of the bag; attachment means operative to releasably secure the head member to the upper end of the rod assembly; and means operative to selectively move the rod assembly between an extended travel configuration having a length greater than the length of the longest club of the set of the clubs, whereby the head may be releasably attached to the upper end of the rod assembly so as to position the solid lower face in protective overlying relation to the head of the longest club to provide protection for the clubs in travel scenarios, and a retracted play configuration having a length less than the length of the longest club, whereby the head member may be removed from the rod assembly so that the rod assembly may reside unobtrusively in the bag during golf play. This arrangement provides effective longitudinal protection against club breakage during travel scenarios while minimizing storage problems with respect to the accessory device during golf play scenarios.

According to a further feature of the invention, the bag includes a storage pocket and the head member is sized and configured to fit in the storage pocket. With this arrangement, the head member is readily available when it is again desired to use the accessory device in its travel configuration.

According to a further feature of the invention, the golf set includes a flexible hood adapted to be releasably secured to the upper end of the bag in covering relation to the heads of the clubs and the head member is sized and configured to fit within the hood with the accessory device in its travel configuration. This arrangement allows the accessory device to be used in its travel configuration without interfering with the normal operation of the various sizes and shapes of golf bag hoods.

According to a further feature of the invention, the rod assembly comprises a telescoping assembly including inner and outer tubular members and the operative means comprises a series of longitudinally spaced holes in one of the tubular members and a spring biased button on the other tubular member for selective locking coaction with one of the holes to adjustably determine the length of the rod assembly. This allows the device to be readily adjusted to accommodate a wide variety of lengths of the longest club.

In the disclosed embodiment of the invention, the head member comprises a molded plastic member having a solid plate configuration including a relatively thick and relatively rigid central main body portion and a relatively thin and relatively flexible circumferential portion constituted by a plurality of circumferentially spaced circumferential sections defined by a circumferentially spaced series of inwardly extending slots. This construction allows the head member to fit within a wide variety of hood sizes.

The invention further provides a method for use with a golf set including a set of golf clubs and a golf bag for receiving the clubs with the lower ends of the clubs positioned on a base of the bag and the clubs extending upwardly within the bag to position at least some of the club heads at a level above the top of the bag.

According to the invention method, a head member is provided defining a solid lower face; an extensible rod assembly is provided having upper and lower ends; attachment means are provided operative to releasably secure the head member to the upper end of the rod assembly; the rod assembly is positioned in the golf bag with the lower end thereof positioned on the base of the golf bag and the rod assembly extending upwardly in the bag to position the upper end thereof at a location proximate the upper end of the bag; for travel requirements, the rod assembly is moved to an extended travel configuration having a length greater than the length of the longest club of the set of clubs and the head member is releasably attached to the upper end of the rod assembly so as to protectively position the solid lower face in overlying relation to the head of the longest club to provide protection for the clubs; and for golf play requirements, the rod assembly is moved to a retracted play configuration having a length less than the length of the longest club and the head member is removed from the upper end of the rod assembly so that the rod assembly may reside unobtrusively in the bag during golf play. With this methodology, protection is provided for the golf clubs during travel without interfering with the normal usage of the golf clubs during golf play.

According to a further feature of the invention methodology, the golf bag has a storage pocket and the method includes the further step of storing the head member in the storage pocket when not releasably attached to the upper end of the rod assembly. With this methodology the clubs are protected during transport, there is no interference with normal usage of the golf clubs during golf play, and the protective feature may again be readily established when it is again time to transport the clubs.

BRIEF DESCRIPTION OF THE DRAWINGS

FIG. 1 is a perspective view of an accessory device according to the invention;

FIG. 2 is a perspective view showing the accessory device positioned in a golf bag;

FIG. 5 is a fragmentary view showing details of the manner in which a head member of the device is attached to a rod assembly of the device;

DETAILED DESCRIPTION OF THE PREFERRED EMBODIMENT

Figure 3:
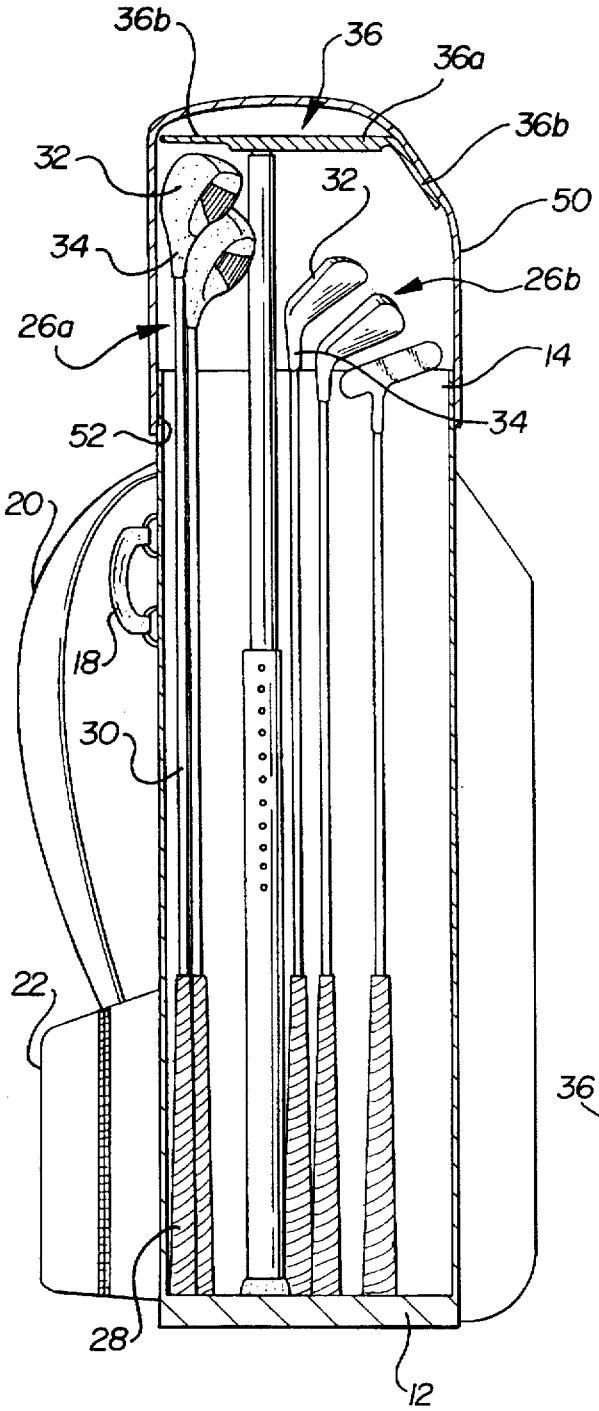
FIG. 3 is a somewhat schematic cross-sectional view showing the accessory device positioned in the golf bag during shipment.

The invention accessory device 10 is intended for use in association with a golf bag 11 of the type including a base 12, an upper collar 14, side panels 16 connecting the base and the collar, a handle 18, a shoulder strap 20, and one or more side pockets 22. It will be understood that the golf bag, in conventional fashion, is circumferentially reinforced and longitudinally reinforced so that it has longitudinal and circumferential integrity. A partition 24 is positioned in known manner within collar 14 to provide selective separation of the golf clubs. Golf bag 11 is intended in known manner to receive a set of golf clubs with each club 26 including a handle 28, a shaft 30, and a head 32 connected to the shaft 30 via a hosel 34. Clubs 26 may include in known manner one or more woods 26*a* and one or more irons 26*b*. Clubs 26 are positioned in known manner in bag 16 with the lower ends of the club handles positioned on the base 12 of the bag and the clubs extending upwardly within the bag to position the club heads 32 at a level above the top of the bag.

Accessory device 10, broadly considered, includes a head member 36 and a rod assembly 38.

Figure 6:
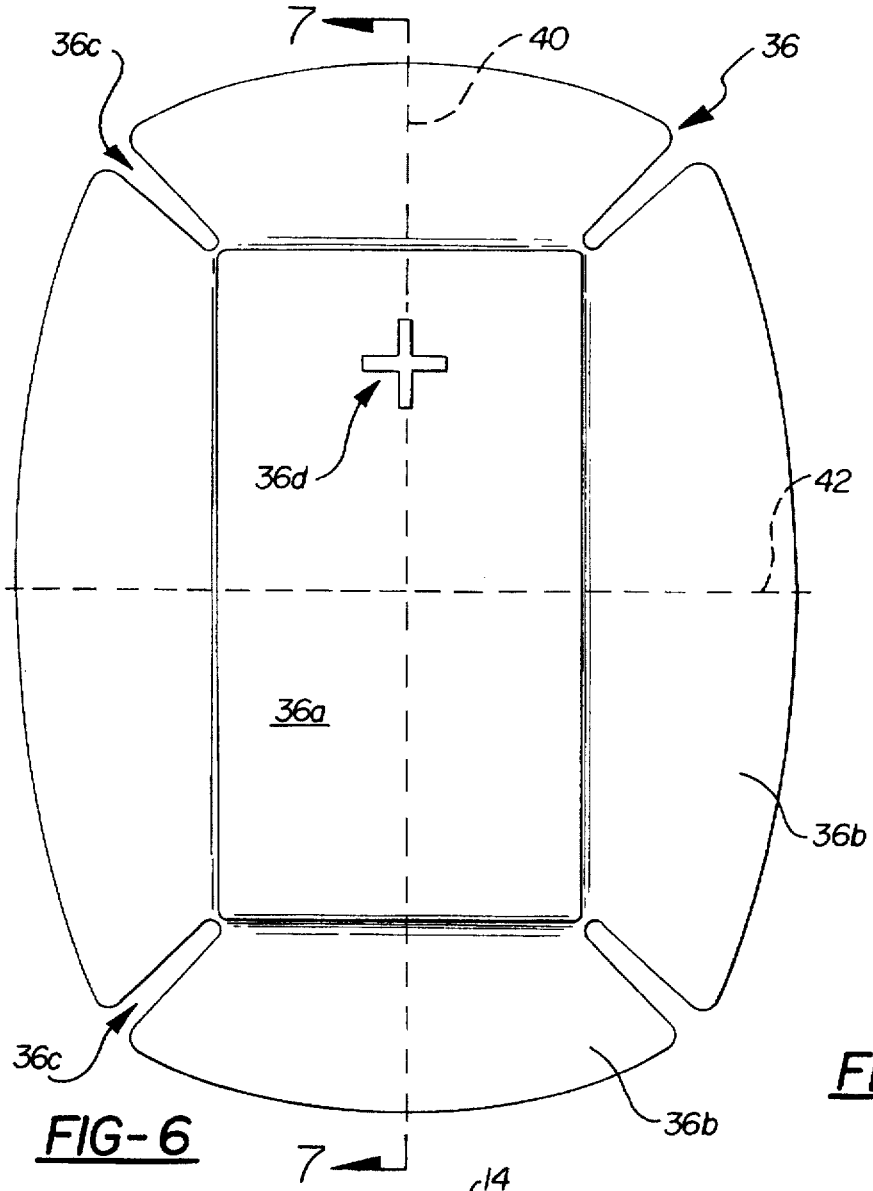
FIG. 6 is a bottom view of the head member.
Figure 7:
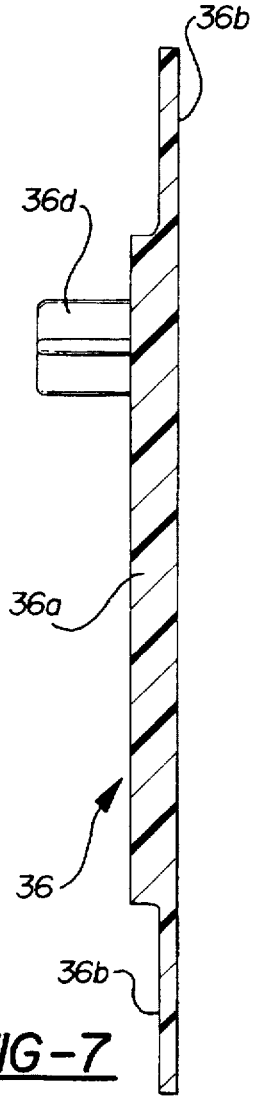
FIG. 7 is a cross-sectional view taken on line 7—7 of FIG. 6.
Figure 9:
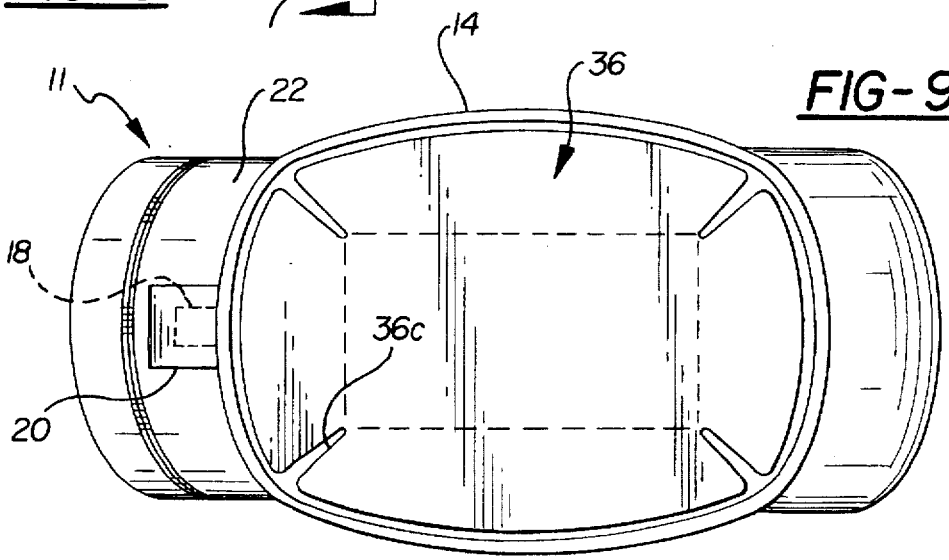
FIG. 9 is a top view showing the accessory device positioned within a golf bag.
Figure 8:
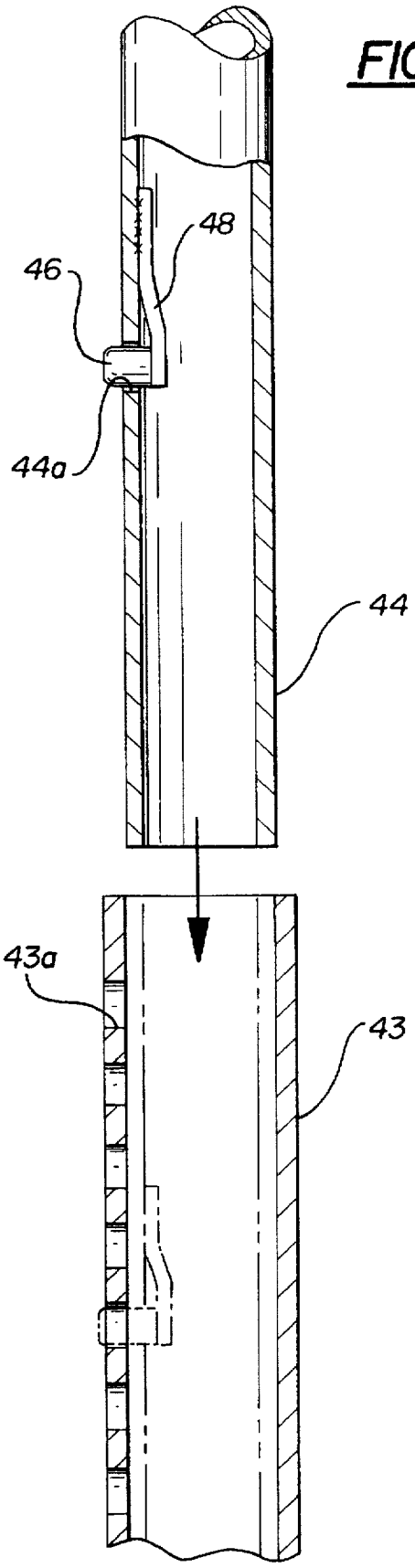
FIG. 8 is a detail view showing the manner in which inner and outer tubular members of the rod assembly coact.
Figure 10:
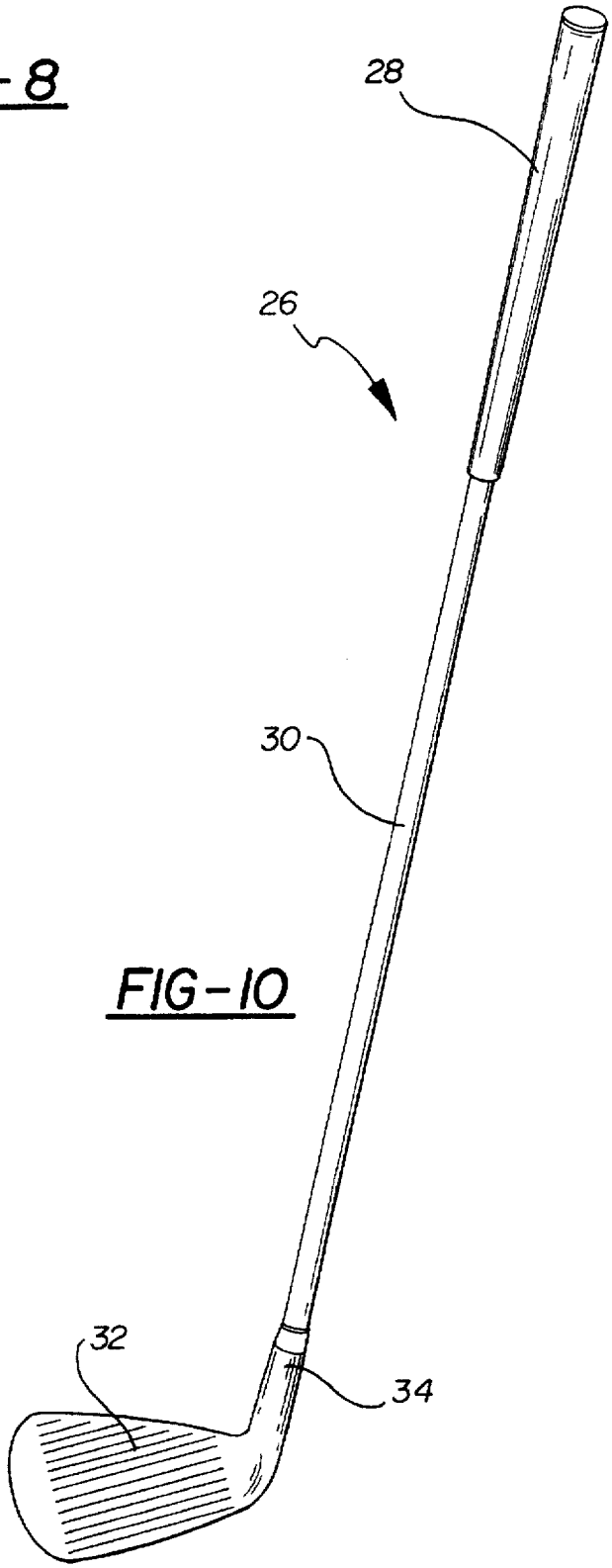
FIG. 10 is a perspective view of a typical golf club.

Head member 36 is formed of a suitable plastic material in an injection molding process. The head member has a solid plate configuration and a semi-rigid construction. Specifically, head member 36 has an oblong configuration and includes a generally rectangular relatively thick, semi-rigid main body portion 36*a* and a relatively thin and relatively flexible circumferential flange portion constituted by a series of circumferentially spaced flange sections 36*b* separated from each other by a series of circumferentially spaced, inwardly extending slots 36*c*. The described construction is such that the flange sections 36*b* will normally lie in the same plane as the main body portion 36*a* to present a generally planar configuration but may flex downwardly relative to the main body portion, by virtue of the slots 36*c* and by virtue of the relatively thin cross-section of the flange sections, to assume flexed configurations relative to the main body portion. Head member 36 further includes an integral plug 36*d* projecting downwardly from the lower face of main body portion 36*a* and having an "X" configuration in cross-section. Plug 36*d*, as best seen in FIG. 6, is located on the front to rear center line 40 of the head member but is offset with respect to the side to side center line 42 of the head member. As best seen in FIG. 9, the overall size and configuration of head member 36 preferably corresponds generally to the overall cross-sectional size and configuration of the golf bag with which it is to be used so that the lower face of the head member overlies and provides protection for the entire cross-sectional area of the golf bag.

Rod assembly 38 includes a cylindrical lower outer telescopic tube 43 and a cylindrical upper inner telescopic tube 44. Tubes 43 and 44 may be formed for example of aluminum and are sized to fit telescopically one within the other in known manner so as to vary the overall length of the rod assembly in response to relative telescopic sliding movement of the tubes. Lower or outer tube 43 includes a series of aligned longitudinally spaced holes 43*a*. Holes 43*a* may be spaced apart, for example, by a distance of 1 inch. Upper or inner tube 44 includes a locking button 46 projecting through a tube aperture 44*a* and carried on the free end of a cantilever leaf spring 48 fixedly secured to the inner surface of the tube. It will been that with inner tube 44 inserted in outer tube 43, the overall length of the rod assembly may be selectively adjusted by adjusting the hole 43*a* in which the button 46 is received. In adjusting the length of the rod assembly it is preferable that the tube 44 be slid into tube 43 with the button 46 angularly displaced with respect to the holes 43*a* until the desired position of longitudinal adjustment is reached whereafter tube 44 may be rotated relative to tube 43 to snap button 46 into locking engagement with the desired aperture 43*a*.

Figure 4:
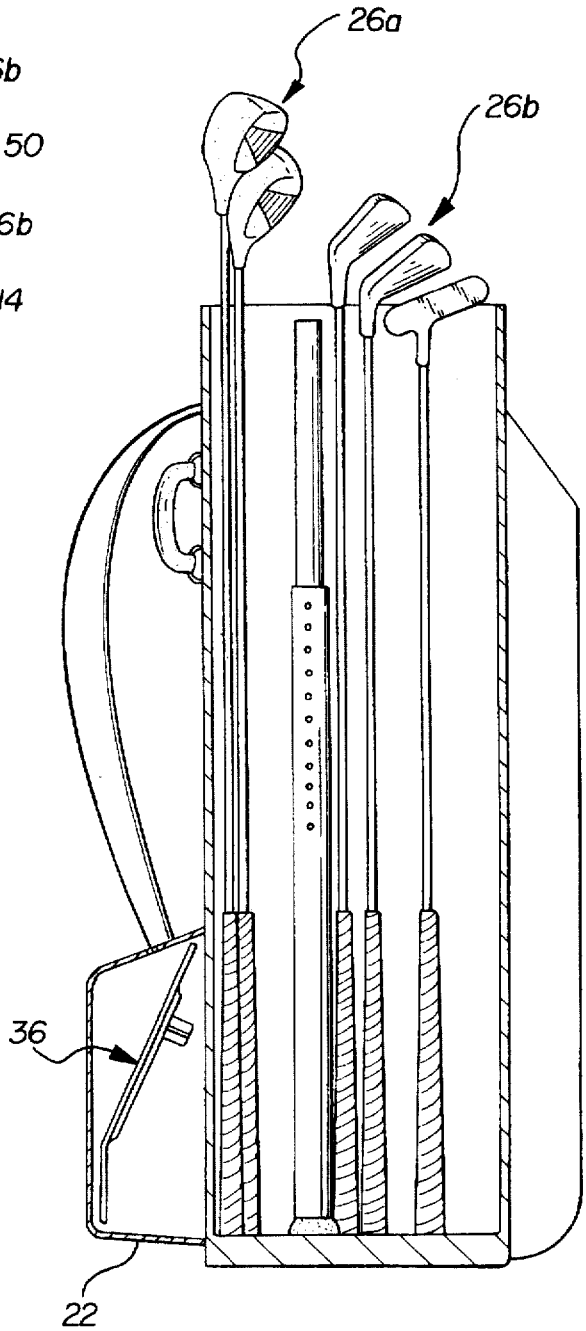
FIG. 4 is a somewhat schematic cross-sectional view showing the accessory device positioned in the golf bag during golf play.

Rod assembly 38 is intended to move between an extended travel configuration, seen in FIG. 3, having a length greater than the length of the longest club of the set of clubs (typically one of the woods 26*a*) and a retracted golf play configuration, seen in FIG. 4, having a length less than the length of the longest club. For example, and as shown, the assembly in the retracted golf play configuration may have a length somewhat less than the height of the golf bag so that the upper end of the rod assembly is positioned proximate but below the top of the golf bag so that the rod assembly may reside unobtrusively in the bag during golf play.

With the rod assembly in the extended travel configuration of FIG. 3, head member 36 is releasably secured to the upper end of upper, inner tube 44 by pushing the plug 36*d* downwardly into the open upper end of tube 44. For this purpose, plug 36*d* has a diametric configuration presenting an interference fit with the bore of tube 44 so that the plug may be moved readily in and out of the bore but will remain in position in the bore until forcibly removed. In the travel configuration of FIG. 3, it will be seen that the head member overlies the longest club and thereby all of the clubs in the bag so as to protect the clubs against shaft breakage during storage or shipment.

It is envisioned that the golf bag will include a conventional flexible fabric hood 50 which may be releasably secured to the collar 14 of the bag using known snap fasteners 52. With hood 50 in position and the accessory device in its travel configuration, one or more of the flexible flange sections 36b of the head member may flex downwardly if necessary to allow the head member to be positioned within the hood and, in extreme cases, the semi-rigid main body 36a of the head member may also flex. When it is desired to use the golf bag and golf clubs for golf play, hood 50 is removed, head member 36 is removed from the upper end of the rod assembly and stored in side pocket 22 and the rod assembly is moved to its retracted play configuration of FIG. 4 by appropriate release of button 46 from the engaged hole 43a and the positioning of the button in a lower hole 43a corresponding to the desired retracted length of the rod assembly.

The accessory device of the invention will be seen to provide excellent protection for the golf clubs during storage or shipment; reside unobtrusively in the bag during golf play; and be readily reconverted to a protective travel configuration by simply removing the head member from the storage pocket, extending the rod assembly, and reattaching the head member to the upper end of the rod assembly.

The invention accessory device is especially effective in preventing golf club damage during the ever increasing air transit of golf clubs wherein a major problem has arisen with respect to shaft breakage, typically at the hosel, as a result of rough handling by airline attendants.

Specifically, golf bags are typically literally hurled into the cargo bay of commercial airliners and impact against the far wall of the cargo bay. As a result, the shafts of one or more of the longer golf clubs are often fractured. This problem has become particularly grievous with the increase in popularity of non-ferrous shafts, such for example as boron, boron-graphite, graphite, and titanium, which are especially susceptible to breakage under compressive loading. The invention accessory device will be seen to effectively eliminate this problem since, as the golf bag is hurled toward the far wall of the cargo compartment, the head member of the accessory device is the first to strike the far wall and takes the brunt of the linear forces generated by the considerable mass of the golf bag assembly, rather than allowing the longest club or clubs to effectively strike the far wall and take the brunt of the load of the entire bag and contents, with consequent breakage of the shafts.

Whereas a preferred embodiment of the invention has been illustrated and described in detail, it will be apparent that various changes may be made in the disclosed embodiment without departing from the scope or spirit of the invention.

I claim:

1. An accessory device for use with a golf set including a set of golf clubs and a golf bag for receiving the clubs with the lower ends of the clubs positioned on a base of the bag and the clubs extending upwardly within the bag to position at least some of the club heads at a level above the top of the bag, the device including:

a head member defining a solid lower face having a size and configuration approximating the cross-sectional configuration of the golf bag and including a central region and a circumferential region in surrounding relation to the central region;

an elongated extensible rod assembly having upper and lower ends and a central axis extending between the ends and adapted to be positioned in the golf bag with the lower end thereof positioned on the base of the golf bag and the rod assembly extending upwardly in the bag to position the upper end thereof at a location proximate the upper end of the bag;

attachment means positioned on the central region of the lower face and operative to releasably secure the head member to the upper end of the rod assembly with the circumferential region positioned in surrounding relation to the central axis of the rod assembly; and means operative to selectively move the rod assembly between an extended travel configuration having a length greater than the length of the longest club of the set of clubs, whereby the head member may be releasably attached to the upper end of the rod assembly so as to position the solid lower face in protective overlying relation to the head of the longest club to provide protection for the clubs in travel scenarios, and a retracted play configuration having a length less than the length of the longest club, whereby the head member may be removed from the rod assembly so that the rod assembly may reside unobtrusively in the bag during golf play.

2. An accessory device according to claim 1, for use with a golf set including a golf bag having a storage pocket, wherein:

the head member is sized and configured to fit in the storage pocket so as to be readily available when it is again desired to use the accessory device in its travel configuration.

3. An accessory device according to claim 1 wherein the rod assembly comprises a telescoping assembly including inner and outer tubular members.

4. An accessory device according to claim 3 wherein the operative means comprises a series of longitudinally spaced holes in one of said tubular members and a spring biased button on the other tubular member for selective locking coaction with one of the holes to adjustably determine the length of the rod assembly.

5. An accessory device according to claim 1 wherein the head member has a solid plate configuration.

6. For use with a golf set including a set of golf clubs and a golf bag for receiving the clubs with the lower ends of the clubs positioned on a base of the bag and the clubs extending upwardly within the bag to position at least some of the club heads at a level above the top of the bag, a method of protecting the clubs during travel without interfering with the normal usage of the golf clubs during golf play, the method comprising:

providing a head member defining a solid lower face having a size and configuration approximating the cross-sectional configuration of the golf bag and including a central region and a circumferential region in surrounding relation to the circumferential region;

providing an elongated extensible rod assembly having upper and lower ends and a central axis extending between the end;

providing attachment means positioned on the central region of the lower face and operative to releasably secure the head member to the upper end of the rod assembly with the circumferential region positioned in surrounding relation to the central axis of the rod assembly;

positioning the rod assembly in the golf bag with the lower end thereof positioned on the base of the golf bag and the rod assembly extending upwardly in the bag to position the upper end thereof at a location proximate the upper end of the bag;

for travel requirements, moving the rod assembly to an extended travel configuration having a length greater than the length of the longest club of the set of clubs and releasably attaching the head member to the upper end of the rod assembly so as to protectively position the solid lower face in overlying relation to the head of the longest club to provide protection for the clubs; and for golf play requirements, moving the rod assembly to a retracted play configuration having a length less than the length of the longest club and removing the head member from the upper end of the rod assembly so that the rod assembly may reside unobtrusively in the bag during golf play.

7. A method according to claim 6 wherein the golf bag has a storage pocket and the method includes the further step of storing the head member in the storage pocket when not releasably attached to the upper end of the rod assembly.

8. An accessory device for use with a golf set including a set of golf clubs, a golf bag for receiving the clubs with the lower ends of the clubs positioned on the base of the bag and the clubs extending upwardly within the bag to position at least some of the club heads at a level above the top of the bag, and a flexible hood adapted to be releasably secured to the upper end of the golf bag in covering relation to the heads of the clubs, the device including:

a head member defining a solid lower face;

an extensible rod assembly having upper and lower ends and adapted to be positioned in the golf bag with the lower end thereof positioned on the base of the golf bag and the rod assembly extending upwardly in the bag to position the upper end thereof at a location proximate the upper end of the bag;

attachment means operative to releasably secure the head member to the upper end of the rod assembly; and means operative to selectively move the rod assembly between an extended travel configuration having a length greater than the length of the longest club of the set of clubs, whereby the head member may be releasably attached to the upper end of the rod assembly so as to position the solid lower face in protective overlying relation to the head of the longest club to provide protection for the clubs in travel scenarios, and a retracted play configuration having a length less than the length of the longest club, whereby the head member may be removed from the rod assembly so that the rod assembly may reside unobtrusively in the bag during golf play;

the head member being sized and configured to fit within the hood with the accessory device in its travel configuration.

9. An accessory device for use with a golf set including a set of golf clubs and a golf bag for receiving the clubs with the lower ends of the clubs positioned on a base of the bag and the clubs extending upwardly within the bag to position at least some of the club heads at a level above the top of the bag, the device including:

a head member defining a solid lower face;

an extensible rod assembly comprising a telescoping assembly including upper and lower tubular members, the rod assembly having upper and lower ends and adapted to be positioned in the golf bag with the lower end thereof positioned on the base of the golf bag and the rod assembly extending upwardly in the bag to position the upper end thereof at a location proximate the upper end of the bag;

a plug projecting downwardly from the lower face of the head member for releasable receipt in an open upper end of the upper tubular member whereby to releasably secure the head member to the upper end of the rod assembly; and means operative to selectively move the rod assembly between an extended travel configuration having a length greater than the length of the longest club of the set of clubs, whereby the head member may be releasably attached to the upper end of the rod assembly so as to position the solid lower face in protective overlying relation to the head of the longest club to provide protection for the clubs in travel scenarios, and a retracted play configuration having a length less than the length of the longest club, whereby the head member may be removed form the rod assembly so that the rod assembly may reside unobtrusively in the bag during golf play.

10. An accessory device for use with a golf set including a set of golf clubs and a golf bag for receiving the clubs with the lower ends of the clubs positioned on a base of the bag and the clubs extending upwardly within the bag to position at least some of the club heads at a level above the top of the bag, the device including:

a head member defining a solid lower face;

an extensible rod assembly having upper and lower ends and adapted to be positioned in the golf bag with the lower end thereof positioned on the base of the golf bag and the rod assembly extending upwardly in the bag to position the upper end thereof at a location proximate the upper end of the bag;

attachment means operative to releasably secure the head member to the upper end of the rod assembly; and means operative to selectively move the rod assembly between an extended travel configuration having a length greater than the length of the longest club of the set of clubs, whereby the head member may be releasably attached to the upper end of the rod assembly so as to position the solid lower face in protective overlying relation to the head of the longest club to provide protection for the clubs in travel scenarios, and a retracted play configuration having a length less than the length of the longest club, whereby the head member may be removed form the rod assembly so that the rod assembly may reside unobtrusively in the bag during golf play;

the head member comprising a molded plastic member having a solid plate configuration and including a relatively thick and a relatively rigid central main body portion and a relatively thin and relatively flexible circumferential portion.

11. An accessory device for use with a golf set including a set of golf clubs and a golf bag for receiving the clubs with the lower ends of the clubs positioned on a base of the bag and the clubs extending upwardly within the bag to position at least some of the club heads at a level above the top of the bag, the device including:

a head member defining a solid lower face;

an extensible rod assembly having upper and lower ends and adapted to be positioned in the golf bag with the lower end thereof positioned on the base of the golf bag and the rod assembly extending upwardly in the bag to position the upper end thereof at a location proximate the upper end of the bag;

attachment means operative to releasably secure the head member to the upper end of the rod assembly; and means operative to selectively move the rod assembly between an extended travel configuration having a length greater than the length of the longest club of the set of clubs, whereby the head member may be releasably attached to the upper end of the rod assembly so as to position the solid lower face in protective overlying relation to the head of the longest club to provide protection for the clubs in travel scenarios, and a retracted play configuration having a length less than the length of the longest club, whereby the head member may be removed from the rod assembly so that the rod assembly may reside unobtrusively in the bag during golf play;

the head member comprising a molded plastic member having a solid plate configuration and including a relatively thick and relatively rigid central main body portion and a relatively thin and relatively flexible circumferential portion;

the circumferential portion including a plurality of circumferentially spaced inwardly extending slots operative to divide the circumferential portion into a plurality of separate flexible circumferential sections.

12. A golf assembly comprising:

a golf bag for receiving a set of golf clubs with the lower ends of the clubs positioned on a base of the bag and the clubs extending upwardly within the bag to position at least some of the club heads at a level above the top of the bag;

a head member defining a solid lower face;

an extensible rod assembly, having upper and lower ends, positioned in the golf bag with the lower end thereof positioned on the base of the golf bag and the rod assembly extending upwardly within the bag to position the upper end thereof at a location proximate the upper end of the bag;

attachment means operative to releasably secure the head member to the upper end of the rod assembly; and means operative to selectively move the rod assembly between an extended travel configuration having a length greater than the length of the longest club of the set of clubs, whereby the head member may be releasably attached to the upper end of the rod assembly so as to position the solid lower face thereof in protective overlying relation to the head of the longest club to provide protection for the clubs in travel scenarios, and a retracted golf play configuration having a length less than the length of the longest club, whereby the head member may be removed from the rod assembly so that the rod assembly may reside unobtrusively in the bag during golf play.

13. A golf assembly according to claim 12 wherein:

the golf bag includes a storage pocket; and the head member is sized and configured to fit in the storage pocket so as to be readily available when it is again desired to use the rod assembly in its travel configuration.

14. A golf assembly according to claim 12 wherein:

the golf bag includes a flexible hood adapted to be releasably secured to the upper end of the bag in covering relation to the heads of the clubs; and the head member is sized and configured to fit within the hood with the rod assembly in its travel configuration.

* * * * *